US005613544A

United States Patent [19]

Schaefer

[11] Patent Number: 5,613,544

[45] Date of Patent: Mar. 25, 1997

[54] MOLDING SYSTEM

[76] Inventor: Jerry E. Schaefer, 351 Forest Loop, Mandeville, La. 70471

[21] Appl. No.: 370,626

[22] Filed: Jan. 10, 1995

[51] Int. Cl.[6] ..... A47H 13/00

[52] U.S. Cl. ..... 160/395; 160/371; 52/222

[58] Field of Search ..... 160/369, 371, 160/392, 395, 394, 353, 179; 52/202, 203, 222

[56] References Cited

U.S. PATENT DOCUMENTS

| | | | |
|---|---|---|---|
| 2,759,538 | 8/1956 | Long | 160/395 X |
| 3,143,165 | 8/1964 | Lewis et al. | 160/394 |
| 3,222,841 | 12/1965 | Lipof | 160/394 X |
| 4,044,813 | 8/1977 | Emmons | 160/369 |
| 4,084,360 | 4/1978 | Reckson | 160/371 X |
| 4,193,235 | 3/1980 | Cucchiara | 52/222 X |
| 4,233,790 | 11/1980 | Meadows | 160/395 X |
| 4,333,284 | 6/1982 | Meadows | 160/179 X |
| 4,370,792 | 2/1983 | Watts | 160/392 X |
| 4,670,136 | 6/1987 | Schmidt et al. | 209/403 |
| 4,690,192 | 9/1987 | Stilling | 160/395 X |
| 4,763,452 | 8/1988 | Harvey | 160/395 X |
| 4,899,797 | 2/1990 | Green | 160/395 |
| 5,046,546 | 9/1991 | Benedyk et al. | 160/371 |
| 5,143,138 | 9/1992 | Zwart | 160/395 |
| 5,203,055 | 4/1993 | Broadwater, Sr. | 24/462 |
| 5,209,029 | 5/1993 | Foerst | 160/392 X |
| 5,242,004 | 9/1993 | Stilling | 160/395 X |

*Primary Examiner*—David M. Purol
*Attorney, Agent, or Firm*—Joseph N. Breaux

[57] ABSTRACT

A molding system having a mechanism for securing an air barrier across the area bounded by the molding system. The molding system comprises: a bracket member and a retaining cap strip. The bracket member has a bracket width, a longitudinal axis, and a first grooved channel formed therein. The first grooved channel is oriented substantially in parallel with the longitudinal axis and has a predetermined maximum groove width. In use, the bracket member is secured to the frame work which forms the window, or other opening, with nails, screws or other fastening devices. The retaining cap strip has a cap member and an insertion member. The insertion member is dimensioned in a manner such that a terminal section of the insertion member is insertable into the first grooved channel and retained therein by contact between a portion of the terminal section and a portion of the bracket member defining the grooved channel. The cap member has a cap width greater than the predetermined maximum groove width.

14 Claims, 2 Drawing Sheets

MOLDING SYSTEM

TECHNICAL FIELD

The present invention relates to devices for constructing an air deflecting barrier across an open frame and more particularly to devices for constructing an air deflecting barrier across an open frame that have a mechanism for securing a sheet of plastic in place across an open area.

BACKGROUND ART

In many areas of the country, screen porches and the like are usable for only a period of the year. Because screening is made to allow the passage of air, it would be desirable to have a molding system which allowed the area of screening to be covered with an air impermeable barrier, such as plastic sheeting, when the weather became so cold that wind made the screened in area uncomfortable for use. In addition, air barriers are more and more important in attempting to reduce the energy consumed in heating and cooling homes. It would be desirable, therefore, to have a system for covering an area with an air impermeable barrier that allowed the air barrier to be easily and quickly installed, replaced and removed.

It would be further benefit if the system were easy and inexpensive to install. It would be a still further benefit if the system was adaptable for use in a variety of window type arrangements.

GENERAL SUMMARY DISCUSSION OF INVENTION

It is thus an object of the invention to provide a molding system that includes a mechanism for securing an air barrier into place across the area bounded by the molding.

It is a further object to provide a molding system having a mechanism for securing an air barrier across the opening bounded by the molding that is easy to install.

It is a further object of the invention to provide a molding system having a mechanism for securing an air barrier across the area bounded by the molding that further includes a mechanism for securing a section of screening across the area.

It is a further object of the invention to provide a molding system that is easy to use.

It is a still further object of the invention to provide a molding system that inexpensive to install and construct.

Accordingly a molding system is provided which has a mechanism for securing an air barrier across the area bounded by the molding system. The molding system comprises: a bracket member and a retaining cap strip.

The bracket member has a bracket width, a longitudinal axis, and a first grooved channel formed therein. The first grooved channel is oriented substantially in parallel with the longitudinal axis and has a predetermined maximum groove width. The bracket member may be constructed of any of the materials known in the art of which conventional molding is constructed such as wood, aluminum, or vinyl. In use, the bracket member is secured to the frame work which forms the window, or other opening, with nails, screws or other fastening devices.

The retaining cap strip has a cap member and an insertion member. The insertion member is dimensioned in a manner such that a terminal section of the insertion member is insertable into the first grooved channel and retained therein by contact between a portion of the terminal section and a portion of the bracket member defining the grooved channel. The cap member has a cap width greater than the predetermined maximum groove width. The retaining cap strip is used in conjunction with the first grooved channel to secure a sheet of plastic film over the area bounded by the bracket member. The retaining cap strip is removed from the bracket and the edge section of a sheet of plastic film is positioned over the first grooved channel. The insertion member is then positioned over the first grooved channel and forced into the first grooved channel along with the edge section of the plastic film. Contact between a terminal section of the retaining member and a portion of the bracket member defining the first grooved channel holds the insertion member and the sheet of plastic film in place. Once the sheet of plastic film has been attached to all the bracket members bounding the area to be closed off from air flow, the flow of air is closed off. When it is desired to replace the plastic sheeting or restore the flow of air through the area, the plastic sheeting thus installed may be removed by grasping an end of the retaining cap strip and pulling the retaining cap strip free of the bracket member.

In a preferred embodiment of the molding system, the bracket member further includes a second grooved channel oriented substantially in parallel with the first grooved channel. This grooved channel is dimensioned to receive therein a conventional screen spline and screening. This allows the area bounded by the molding system to be used as a screened opening.

In another preferred embodiment of the molding system of the invention, the bracket member of the molding system having a second grooved channel further includes a third grooved channel oriented substantially in parallel with the first grooved channel. When the bracket member includes three grooved channels, the first grooved channel is positioned between the second and third grooved channels. This allows construction of screened openings side by side with the use of one bracket section having three grooved channels between the openings to be screened and the use of bracket sections having two grooved channels along the other edges of the openings.

In a preferred embodiment of the retaining cap strip, the insertion member is of a length substantially equal to the length of the retaining cap strip. In another preferred embodiment, the retaining cap strip is constructed of a flexible material such as rubber or plastic.

In another preferred embodiment of the bracket member, the first grooved channel is defined by a first and second side wall and a bottom surface. The bottom surface has a plurality of apertures formed therethrough for allowing attachment of the bracket member to a framework with screws or other securing devices. The first sidewall preferably includes a first lip portion extending from an end of the first sidewall located farthest from the bottom surface and into the grooved channel; and the second sidewall preferably includes a second lip portion extending from an end of the second sidewall located farthest from the bottom surface and into the grooved channel. The first and second lip portions define an elongated aperture into the first grooved channel having an aperture width smaller than the predetermined maximum groove width. When a bracket member having this first grooved channel construction is utilized in the molding system, it is also preferred that the terminal section of the insertion member to have a portion thereof of a width greater than the aperture width and less than the maximum groove width. It is also preferred that a section of the insertion member located between the terminal section and the cap member have a width substantially equal to the aperture width.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
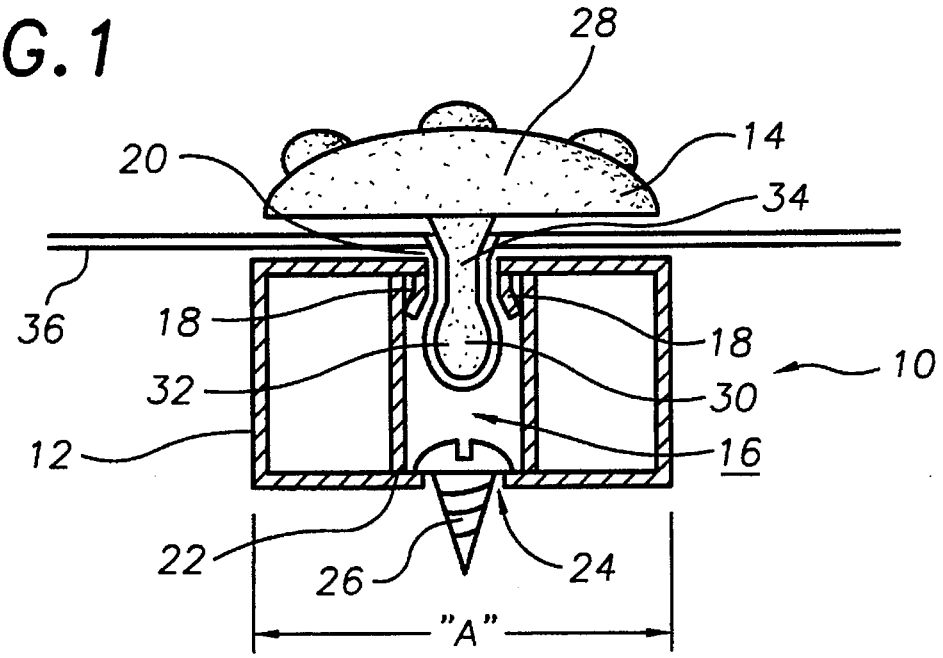
FIG. 1 is a cross-sectional view of an exemplary embodiment of the bracket member and retaining cap strip of the molding system.

FIG. 1 shows an exemplary embodiment of the molding system of the present invention generally designated by the numeral 10. Molding system 10 includes a bracket member 12 and a retaining cap strip 14.

Bracket member 12 is constructed of plastic, and is about ½" wide in the direction "A". Bracket 12 includes a first grooved channel 16 having two lip portions 18 which define a 3/32" wide aperture 20 into first grooved channel 16. Each lip portion 18 has a first middle portion **18*a* extending toward a bottom portion 22 of first grooved channel 16 and a second terminal portion 18*b* angled toward an adjacent sidewall 16*a* that partially defines grooved channel 16. Bottom portion 22 of first grooved channel 16 has a plurality of screw apertures 24 through which screws 26 are positioned when securing bracket member 12** to a frame.

Retaining cap strip 14 is constructed of a flexible plastic material and includes a cap member 28 and an insertion member 30. Insertion member 30 includes a terminal section 32 and a connecting section 34. Terminal section 32 has a width of about 7/64". Connecting section 34 has a width about equal to the width of aperture 20 or about 3/32". Insertion member 30 is used to secure a sheet of plastic 36 into place across an open area bounded by a series of bracket members 12.

Figure 2:
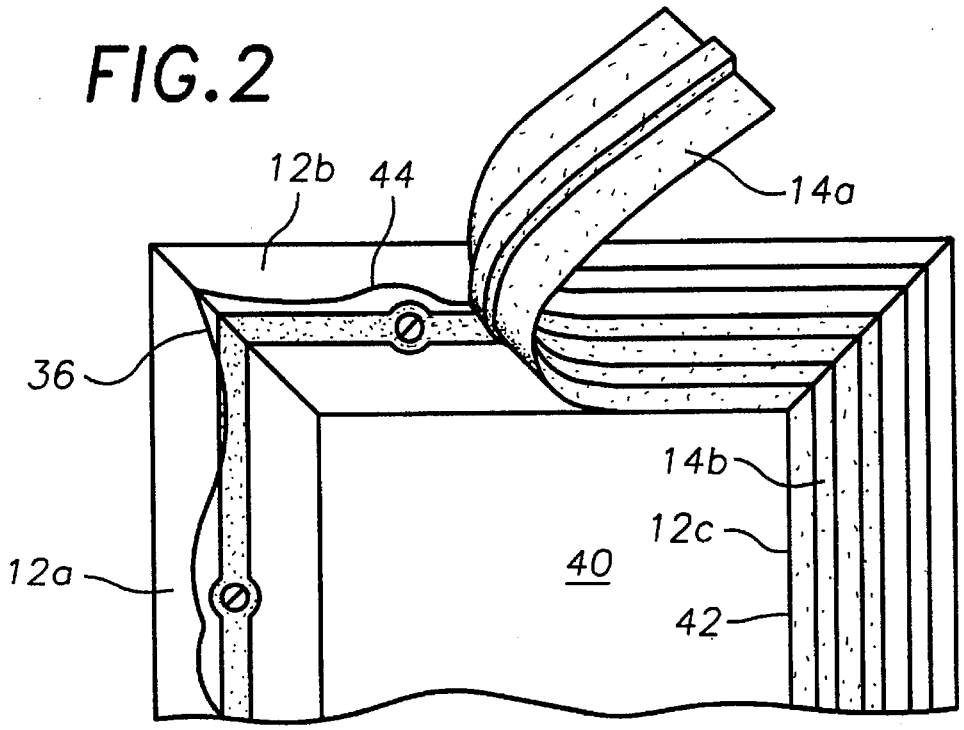
FIG. 2 is a front view of the exemplary embodiments of the bracket member and retaining cap strip in place about an opening and in use securing a sheet of plastic film.

FIG. 2 shows a series of bracket members **12*a*, 12*b*, 12*c* bounding an open area 40 and two sections of retaining cap strip 14*a*, 14*b*. A sheet of clear plastic sheeting 36 is secured along one edge 42 by bracket member 12*c* and retaining cap strip 14*b*. A second edge 44 is partially secured by bracket member 12*b* and retaining cap strip 14*a***.

Figure 3:
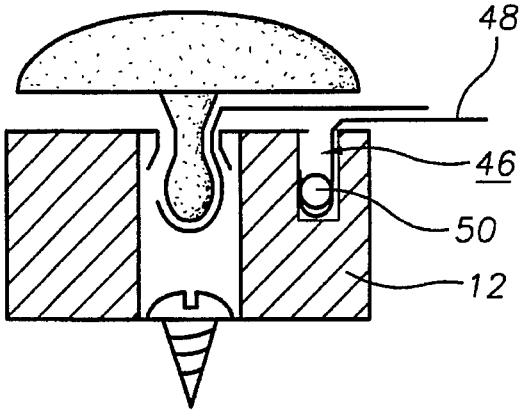
FIG. 3 is a cross-sectional view of a second exemplary embodiment of the bracket member having a second grooved channel.
Figure 4:
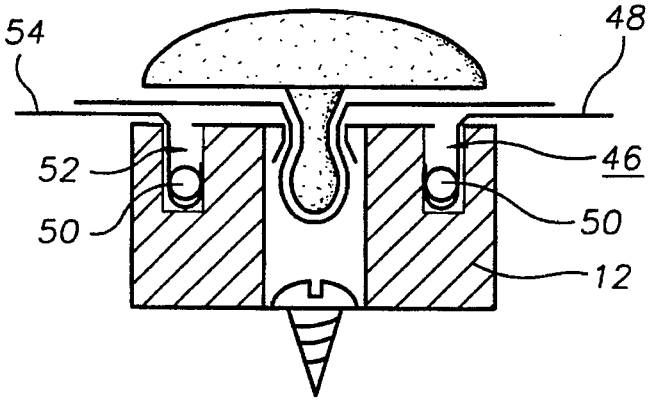
FIG. 4 is a cross-sectional view of a third exemplary embodiment of the bracket member having a second grooved channel.

FIG. 3 shows a cross-sectional view of a two channel bracket member **12*d* having a second grooved channel 46 which is used for securing a section of screening 48 using a rubber spline 50. FIG. 4 shows a cross-sectional view of a three channel bracket member 12*e* having a second grooved channel 46 and a third grooved channel 52 which are used for securing sections of screening 48,54 using rubber splines 50**.

Figure 5:
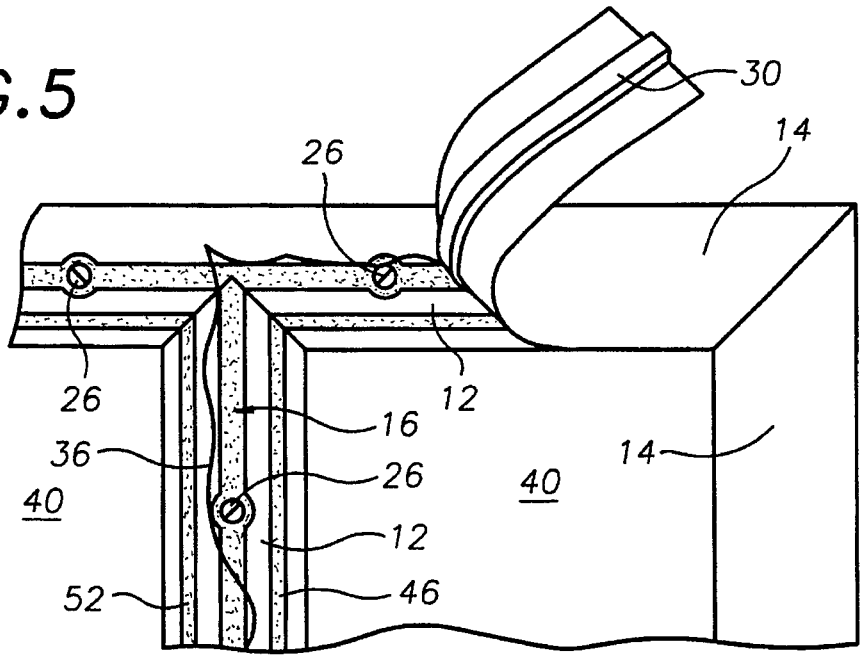
FIG. 5 is a front view of the second and third exemplary embodiments of the bracket member and retaining cap strip in place about a first and second opening and in use securing a sheet of plastic film.

As shown in FIG. 5, the two and three channel bracket members **12*d*, 12*e* are used in combination when two openings are directly adjacent one another. The three channel bracket member 12*e* is used between openings 40. The two channel bracket members 12*d* are used along edges where openings 40** are not adjacent one another.

Use of the molding system 10 is now described with reference to FIGS. 1–5. Sections of bracket member 12 are attached to a rectangular frame (not shown) defining an opening 40 using a series of screws 26 as shown in FIG. 5. Screening is then installed using a rubber spline 50 to secure an edge of the screening within either or both the second and third grooved channels 46,52. Once the screening is in place over opening 40, Retaining cap strip 14 may be installed by inserting terminal section 32 of insertion member 30 into first grooved channel 16. A sheet of plastic sheeting 36 may be secured into place by placing a portion of the plastic sheeting 36 over aperture 20 prior to inserting insertion member 30 into first grooved channel 16.

When it is desired to remove plastic sheeting 36, an edge of retaining cap strip 14 is pried away from bracket member 12 with a utility knife or the like and pulled or peeled away releasing plastic sheeting 36. Retaining cap strip 14 may then be reinstalled in the manner previously described until it is once again desired to cover opening 40 with plastic sheeting.

It can be seen from the preceding description that a method and device for constructing an air deflecting barrier across an open frame which is easy to install, that provides a mechanism for securing a screen across the open area, that is easy to use, and that allows the air deflecting barrier to be easily removed and/or replaced has been provided.

It is noted that the embodiments of the molding system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A molding system comprising:

a bracket member having a bracket width, a longitudinal axis, and a first grooved channel formed therein, said first grooved channel being oriented substantially in parallel with said longitudinal axis and having a predetermined maximum groove width, said first grooved channel being defined by a first and second side wall and a bottom surface, said bottom surface having a plurality of apertures formed therethrough, said first sidewall including a first separate lip portion extending from an end of said first sidewall located farthest from said bottom surface and into said grooved channel, said first lip portion including a first middle portion extending toward said bottom surface and a first terminal portion angled toward and overlying said first sidewall, said second sidewall including a second separate lip portion extending from an end of said second sidewall located farthest from said bottom surface and into said grooved channel, said second lip portion including a second middle portion extending toward said bottom surface and a second terminal portion angled toward and overlying said second sidewall, said first and second lip portions defining an elongated aperture into said first grooved channel having an aperture width smaller than said predetermined maximum groove width; and a retaining cap strip having a cad member and an insertion member, said insertion member being dimensioned in a manner such that a terminal section of said insertion member is insertable into said first grooved channel and retained therein by contact between a portion of said terminal section and a portion of said bracket member defining said grooved channel, said cap member having a cap width greater than said predetermined maximum groove width.

2. The molding system of claim 1, wherein:

said terminal section of said insertion member has a portion thereof of a width greater than said aperture width and less than said maximum groove width.

3. The molding system of claim 1, wherein:

a section of said insertion member located between said terminal section and said cap member has a width substantially equal to said aperture width.

4. The molding system of claim 1, wherein:

said terminal section of said insertion member has a portion thereof of a width greater than said aperture width and less than said maximum groove width; and a section of said insertion member located between said terminal section and said cap member has a width substantially equal to said aperture width.

5. The molding system of claim 4 wherein:

said insertion member is of a length substantially equal to the length of said retaining cap strip.

6. The molding system of claim 4 wherein:

said retaining cap strip is constructed of a flexible material.

7. The molding system of claim 4 wherein:

said insertion member is of a length substantially equal to the length of said retaining cap strip; and said retaining cap strip is constructed of a flexible material.

8. The molding system of claim 1, wherein:

said bracket member further includes a second grooved channel oriented substantially in parallel with said first grooved channel.

9. The molding system of claim 8, wherein:

said bracket member further includes a third grooved channel oriented substantially in parallel with said first grooved channel, said first grooved channel being positioned between said second and third grooved channels.

10. The molding system of claim 1 wherein:

said insertion member is of a length substantially equal to the length of said retaining cap strip.

11. The molding system of claim 1 wherein:

said retaining cap strip is constructed of a flexible material.

12. The molding system of claim 1 wherein:

said insertion member is of a length substantially equal to the length of said retaining cap strip; and said retaining cap strip is constructed of a flexible material.

13. The molding system of claim 12, wherein:

said bracket member further includes a second grooved channel oriented substantially in parallel with said first grooved channel.

14. The molding system of claim 13, wherein:

said bracket member further includes a third grooved channel oriented substantially in parallel with said first grooved channel, said first grooved channel being positioned between said second and third grooved channels.

* * * * *